US009745061B2

(12) United States Patent
Li et al.

(10) Patent No.: US 9,745,061 B2
(45) Date of Patent: Aug. 29, 2017

(54) PROPULSION DEVICES WITH IMPROVED CONTROLS

(71) Applicant: ZAPIP, LLC, Cherry Hill, NJ (US)

(72) Inventors: Raymond Li, St. John's (CA); Nicholas R. Lewis, Fort Lauderdale, FL (US)

( * ) Notice: Subject to any disclaimer, the term of this patent is extended or adjusted under 35 U.S.C. 154(b) by 0 days.

(21) Appl. No.: 15/286,706

(22) Filed: Oct. 6, 2016

(65) Prior Publication Data

US 2017/0021926 A1 Jan. 26, 2017

Related U.S. Application Data

(63) Continuation of application No. 14/312,892, filed on Jun. 24, 2014, now Pat. No. 9,463,876.

(60) Provisional application No. 61/838,417, filed on Jun. 24, 2013.

(51) Int. Cl.

| | |
|---|---|
| ***B64C 29/00*** | (2006.01) |
| ***B64C 39/02*** | (2006.01) |
| ***B63B 35/73*** | (2006.01) |
| ***B63H 11/04*** | (2006.01) |
| *B63H 11/00* | (2006.01) |

(52) U.S. Cl.

CPC ..... *B64C 39/026* (2013.01); *B63B 35/731* (2013.01); *B63H 11/04* (2013.01); *B63H 2011/006* (2013.01)

(58) Field of Classification Search

CPC ..... B64C 15/02; B64C 11/20; B64C 29/04; B64C 37/02; B64C 39/026; B63H 11/04; B63H 2011/006; B63H 11/10

USPC ..... 244/4 A, 4 R, 23 A

See application file for complete search history.

(56) References Cited

U.S. PATENT DOCUMENTS

| | | | | | |
|---|---|---|---|---|---|
| 3,662,973 | A * | 5/1972 | Paine | B64C 39/026 | 244/1 R |
| 4,040,577 | A * | 8/1977 | Moore | B64C 39/026 | 244/4 A |
| 4,915,049 | A * | 4/1990 | Nakamura | B63B 35/731 | 114/144 R |
| 6,161,637 | A * | 12/2000 | Decker | B62D 11/183 | 180/332 |
| 2002/0003188 | A1* | 1/2002 | Moshier | B64C 39/026 | 244/4 R |
| 2009/0134280 | A1* | 5/2009 | Suzuki | A63H 27/002 | 244/155 A |
| 2011/0049306 | A1* | 3/2011 | Yoeli | B64C 29/0025 | 244/23 A |
| 2013/0011220 | A1* | 1/2013 | Jacobsen | B25J 3/04 | 414/2 |
| 2014/0103165 | A1* | 4/2014 | Zapata | B64C 39/026 | 244/4 A |

* cited by examiner

*Primary Examiner* — Richard G Davis
(74) *Attorney, Agent, or Firm* — Nicholas R. Lewis

(57) ABSTRACT

A personal propulsion device adapted to achieve flight by discharging a fluid, including a passenger assembly adapted to support an individual person; at least one fluid discharge nozzle coupled to the passenger assembly, where the nozzle is movable with respect to the passenger assembly to define a range of motion, and where the nozzle is biased towards at least one position in the range of motion.

20 Claims, 4 Drawing Sheets

PROPULSION DEVICES WITH IMPROVED CONTROLS

CROSS-REFERENCE TO RELATED APPLICATION

This application is a continuation of U.S. patent application Ser. No. 14/312,892, filed Jun. 24, 2014, entitled PROPULSION DEVICES WITH IMPROVED CONTROLS, which application is related to and claims priority to U.S. Provisional Patent Application Ser. No. 61/838,417, filed Jun. 24, 2013, entitled PROPULSION DEVICES WITH IMPROVED CONTROLS, the entirety of all of which are incorporated herein by reference.

STATEMENT REGARDING FEDERALLY SPONSORED RESEARCH OR DEVELOPMENT n/a

FIELD OF THE INVENTION

The present invention relates to personal propulsion devices, and more particularly, towards control systems for the movement and/or operation of personal propulsion devices.

SUMMARY OF THE INVENTION

The present disclosure advantageously provides a personal propulsion device adapted to achieve flight by discharging a fluid, including a passenger assembly adapted to support an individual person; at least one fluid discharge nozzle coupled to the passenger assembly, where the nozzle is movable with respect to the passenger assembly to define a range of motion, and where the nozzle is biased towards at least one position in the range of motion. The device may include at least one of a spring, magnet, elastic component, elastomeric component, and dampening component that at least in part biases the nozzle towards the at least one position. A force exerted by the at least one of a spring, magnet, elastic component, elastomeric component, and dampening component on the nozzle may be selectively adjustable by a user to tailor the device operation for a variety of individuals. A magnitude of the biasing of the nozzle may be selectively adjustable. The at least one position may include a position that substantially results in the personal propulsion device hovering in a substantially fixed position, moving substantially forward, or moving substantially upward vertically. The at least one position may be selectively adjustable to be any selected, discrete position within the range of motion. The device may include a pressurized fluid source coupled to the passenger assembly, where the pressurized fluid source delivers pressurized fluid to the passenger assembly and does not achieve flight.

Another personal propulsion device adapted to achieve flight by discharging a fluid is disclosed, including a passenger assembly adapted to support an individual person; at least one fluid discharge nozzle coupled to the passenger assembly, where the nozzle is movable with respect to the passenger assembly to define a range of motion, and at least one of a spring, magnet, elastic component, elastomeric component, and dampening component affecting the movement of the nozzle about the passenger assembly. A force exerted by the at least one of a spring, magnet, elastic component, elastomeric component, and dampening component may be selectively adjustable. The at least one of a spring, magnet, elastic component, elastomeric component, and dampening component may be adjustable to affect a selected portion of the range of motion of the nozzle, where the selected portion may include the entire range of motion, a segment of the range of motion that results in backwards flight of the device, a segment of the range of motion that results in a substantial descent of the device, and/or a segment of the range of motion that results in a substantial ascent of the device Still another personal propulsion device adapted to achieve flight by discharging a fluid is provided, including a passenger assembly adapted to support an individual person; at least one fluid discharge nozzle coupled to the passenger assembly, where the nozzle is movable with respect to the passenger assembly to define a range of motion, and where the range of motion is selectively adjustable. The range of motion may be selectively adjustable to substantially prevent backwards movement of the device, substantially prevent rapid descent of the device, and/or substantially prevent rapid ascent of the device.

Yet another personal propulsion device adapted to achieve flight by discharging a fluid is disclosed, including a passenger assembly adapted to support an individual person; at least one fluid discharge nozzle coupled to the passenger assembly, where the nozzle is movable with respect to the passenger assembly to define a range of motion, and a passenger control element coupled to the nozzle, where the control element is operable to move the nozzle, and where an amount of movement that the nozzle travels in response to input from the control element is selectively adjustable. The device may include one or more gears disposed between the control element and the nozzle, where the one or more gears are selectively engageable with at least one of the nozzle and control element. The one or more gears may be selectively engageable to provide an adjustable movement ratio between the control element and the nozzle. The device may include a sensor operable to detect a movement of the control arm; and a motor coupled to the nozzle, where the motor is operable to move the nozzle based at least partially on a detected movement of the control arm.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present disclosure provides examples of improved controls for personal propulsion systems and methods of use thereof. The personal propulsion systems disclosed herein may generally include a fluid conduit or hose that delivers pressurized fluid to the passenger assembly, and a pressurized fluid source attached to the conduit. Other personal propulsion devices and features thereof are disclosed in U.S. Pat. Nos. 7,258,301 and 8,336,805, as well as U.S. Patent Application Ser. No. 61/801,165, entitled Personal Propulsion Devices With Improved Balance, U.S. Patent Application Ser. No. 61/805,257, entitled Waterproof Rotary Contact Assembly, U.S. Patent Application Ser. No. 61/822,612, entitled Tandem Personal Propulsion Device, and U.S. Patent Application Ser. No. 61/822,885, entitled Multi-Purpose Personal Propulsion System, the entirety of all of which are hereby incorporated by reference.

Figure 1:
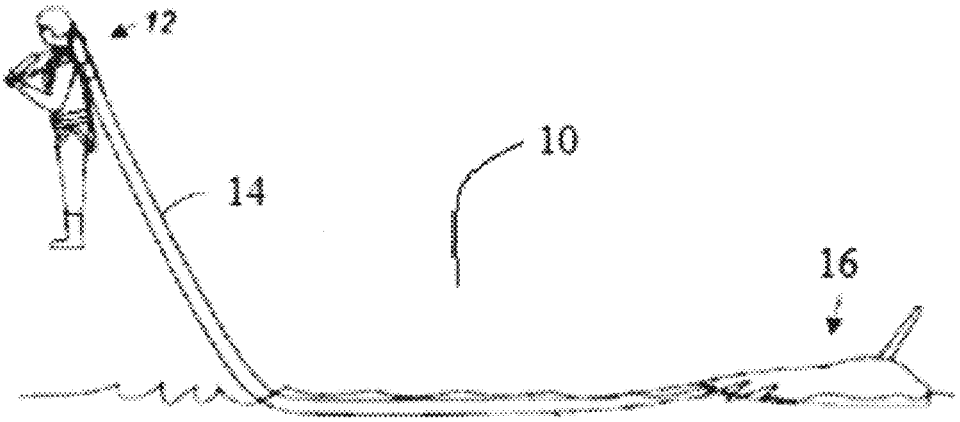
FIG. 1 is an illustration of an example of a personal propulsion system constructed in accordance with the principles of the present disclosure.

Now referring to FIG. 1, a personal propulsion system or device 10 is shown with the passenger assembly 12, the fluid conduit or hose 14, and the pressurized fluid source 16. The pressurized fluid source or unit may include an unmanned marine unit having a substantially water-tight hull (operable on a water surface and/or submersible), a boat, a personal watercraft such as a wave runner or jet ski, or a pump located on land or in/on water.

The passenger assembly may include one or more components that provide or generate a force to aid in elevating, moving, stabilizing, and/or otherwise controllably using the system. For example, the passenger assembly may include one or more nozzles or outlets that discharged a fluid to move, stabilize, elevate, or otherwise affect the position of the passenger assembly. In the examples shown in FIGS. 1 and 2, the passenger assembly includes a plurality of downward-facing nozzles that discharge pressurized fluid received from the pressurized fluid source to move, stabilize, elevate or otherwise direct or orient the passenger assembly as desired.

Figure 2:
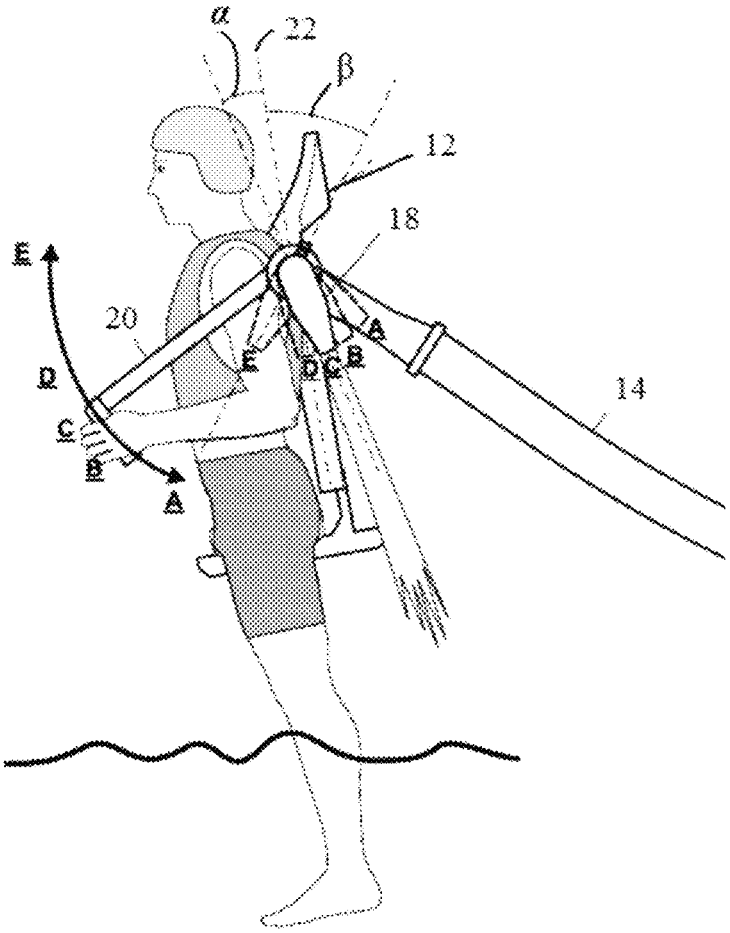
FIG. 2 is an illustration of an example of a personal propulsion device constructed in accordance with the principles of the present disclosure.
Figure 3:
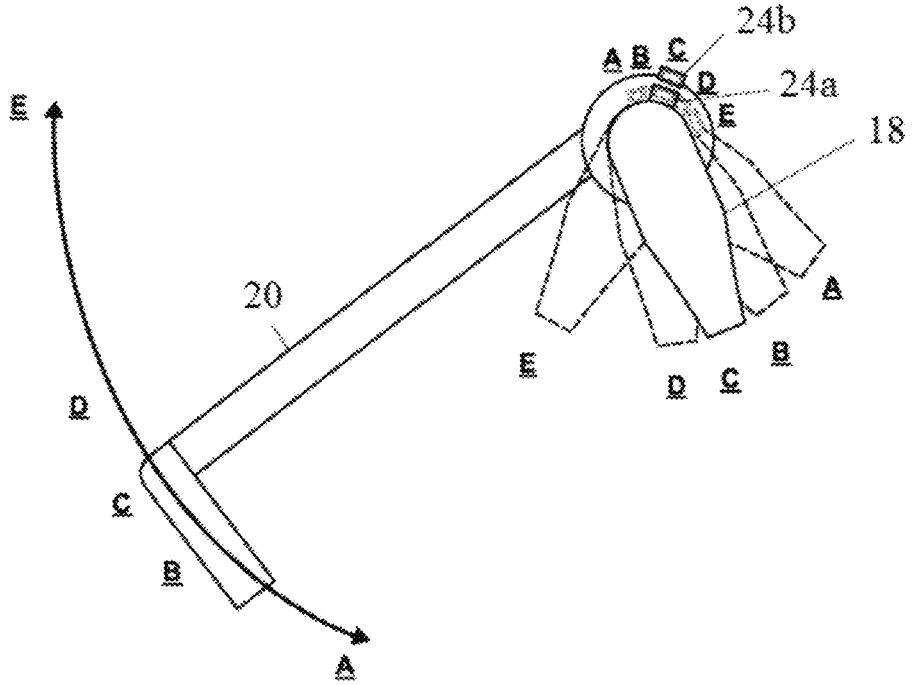
FIG. 3 is a side-view illustration of an example of a nozzle assembly constructed in accordance with the principles of the present disclosure.

FIG. 2 is a side view of an example of a passenger assembly 12. The passenger assembly shown includes a jetpack-like configuration with the near-sided fluid discharge nozzle 18 shown (the nozzle on the opposite shoulder of the pilot or passenger is not shown). As shown in FIGS. 2-3 (FIG. 3 includes only a portion of the passenger assembly for ease of illustration), the nozzle 18 is movable or rotatable about the remainder of the passenger assembly to change the vector or output direction of the nozzle. For example, the nozzle may be moved throughout a range of motion that includes positions A-E. Movement of the nozzle may be controlled by a control input element, which may include a control arm 20 extending from a frame or mounting point of the passenger assembly. The control arm may include a number of telescoping and/or adjustable components to fit a variety of different user physiques or dimensions. Adjustments may include, for example, control arm length, angle, range of motion, or the like. The control arm may define a range of motion correlating to the movement of the nozzle 18. For example, the control arm may be moved throughout a range of motion including positions A-E that result in the respective nozzle positions A-E. The ratio or result of the control arm movement and the corresponding nozzle movement may vary and/or may be adjustable, as described herein.

In the illustrated example, the nozzle may typically be at position (C) for taxiing, where the center line axis of the nozzle forms an angle $\alpha$ with the vertical axis of the passenger assembly, which may be between approximately 2° and approximately 10°. Moving the nozzle(s) to position (A) may result in substantially maximum propulsion and speed, position (E) forms an angle $\beta$ between approximately 5° and approximately 45° between the nozzle axis and the passenger assembly axis, which may result in or provide for quick stops and other maneuvers. With the control arms and/or nozzle(s) position (D), the nozzles centerline axis substantially coincides with the vertical axis of the passenger assembly, which may result in or provide for hovering of the passenger assembly.

The nozzle and/or control arm may be biased towards a selected rotational position, and thus towards a particular fluid discharge direction or vector for the nozzle 18. During use of the personal propulsion system 10, the operator may manipulate the control arms to adjust the nozzle angle or position. If the nozzle angles are not parallel, even small differences in thrust vectors from the nozzles can generate significant roll and yaw moments in the passenger assembly, causing the assembly to roll or turn. For example, the weight of the operator and passenger assembly may be balanced with the weight of the hose and entrained water, and the operator may be able to substantially maintain a hovering position with virtually all the thrust allocated to lift and none to propulsion. If the operator allows the nozzles to go beyond position (D) and towards position (E), a rapid backwards flip or descent may result.

While experienced operators may readily control such movements, it may be more difficult for an inexperienced operator. The unintended turning or rolling of the passenger assembly in any number of directions may cause loss of control before the operator learns how to control such movements. The biasing may allow the control arms and/or nozzles to return to the preselected position without input from an operator (i.e., if the operator lets go of the control arms), and/or may provide an index or reference point within the range of motion of the nozzle/control arms that provides a detectable change in the resistance or attraction of the nozzle/control arms to that preselected biased position (i.e., an increase or decrease in resistance or attraction across the range of motion of the nozzles/control arm).

Figure 4:
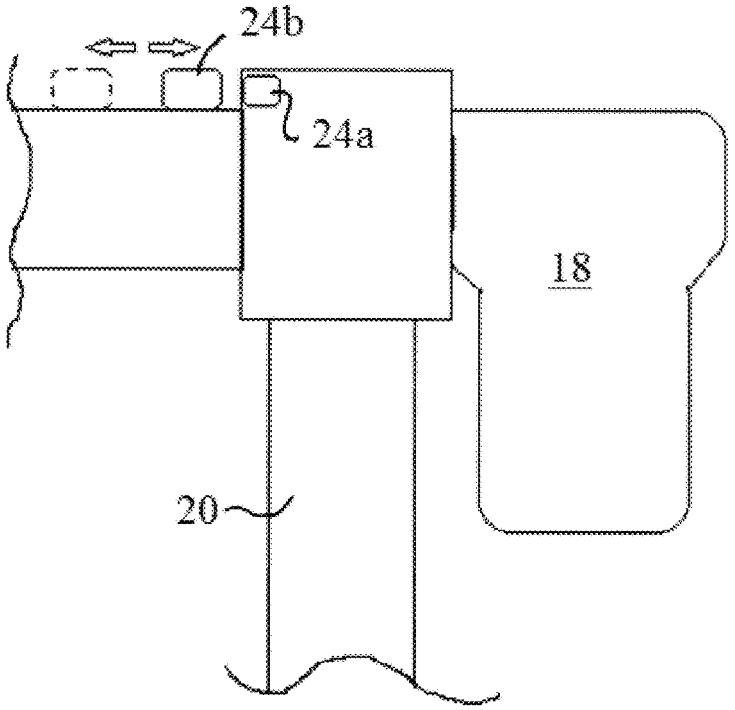
FIG. 4 is a front-view illustration of an example of a nozzle assembly constructed in accordance with the principles of the present disclosure.

The biasing of the nozzle and/or control arm may include coupling an attractant and/or resistant component(s) or mechanism to the control arm(s), nozzle(s), and/or a frame or other portion of the passenger assembly. Examples of suitable attractant and resistant components may include magnets, springs, dampeners, elastic and elastomeric components or inserts, or the like. In the examples shown in FIGS. 2-4, a pair of magnets 24*a*, 24*b* is coupled to a portion of the control arm and a segment of the passenger assembly about which the control arm moves. The first magnet 24*a* is coupled to the control arm or nozzle (or a rotational component or coupling thereof), and moves in conjunction with the control arm/nozzle throughout its range of motion. The second magnet 24*b* is coupled to a static location on the passenger assembly, for example, in proximity to the rotating point where the control arm or nozzle is connected to the remainder of the passenger assembly. The attracting force between the magnets biases the control arm and/or nozzle to the rotational position where the magnets would be substantially aligned. The magnets also provide a gradual increase in their attraction forces as the magnets become closer (or further away) that may provide the operator with tactile or detectable feedback through the control arm to provide a general reference point about the particular position that the control arms or nozzles are in at any given time during operation.

Figure 5:
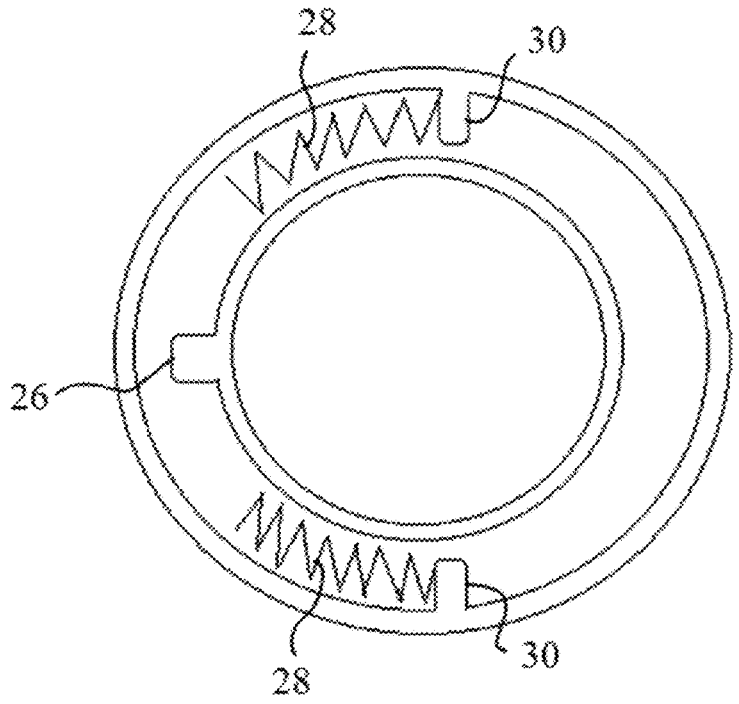
FIG. 5 is a cross-sectional side view of a nozzle assembly constructed in accordance with the principles of the present disclosure.

Alternatively and/or in addition to the use of magnets or other attractive elements that bias the control arm or nozzles towards a particular position, resistant elements may be used to usher the control arms and/or nozzles away from a selected position. For example, as shown in FIG. 5, a portion of the control arm or nozzle may include a protrusion 26 that rotates in conjunction with the nozzle and/or control arm. The protrusion may be within a collar or junction between the nozzle/control arm and a portion of the passenger assembly. Within the path of the protrusion, one or more resistive elements 28 may be positioned to resist movement of the protrusion (and thus the control arm or nozzle) into certain positions (or ranges of positions).

The magnitude of the biasing force for the nozzle and/or control arm position may be selectively adjustable by an operator. For example, where magnets are included, the space between the magnets may be adjusted to either increase or decrease the resulting attraction or repelling forces, as shown by the arrow in FIG. 4. Alternatively and/or in addition, one or more insulating members (not shown) may be selectively adjusted to dampen, block, or otherwise affect a magnetic attraction or repelling force between the magnets. Should springs or other resistive elements be incorporated, a pre-tension or spring constant may be adjusted to provide the desired increase or decrease in resistive force and the resulting bias experienced. The biasing force may be selectively adjusted for all or a portion of the full range of motion of the control arms and/or nozzles.

The biased position (or range of positions) for the control arms or nozzles may be selectively adjustable by an operator. For example, the location of the attraction or repelling elements may be selectively movable, detachable and re-attachable, or the like about the control arm, nozzle, and/or remained of the passenger assembly to provide the desired biased position, which may vary amongst individual operators and applications. For example, an inexperienced operator may have the biased position to (D) for substantial hovering. Other examples may include a biased position providing substantially maximum forward propulsion, rapid ascent, or rapid descent.

In addition to and/or alternatively to the biasing features described herein, the control arm and/or nozzles may also be selectively engaged in a number of discrete positions throughout the range of motion, employing a detent mechanism or the like that provides one or more releasably engageable positions for the nozzle and/or control arm. Examples of such detent positions include, for example, spring-ball detents or discrete gearing that allow an operator to selectively "click" or engage the nozzle or control arms into a set, discrete position, where additional action or input from the operator is required to move the control arm or nozzle from that discrete position.

In addition to and/or alternatively to the biasing and detent features described herein, the range of motion of the nozzle(s) and/or control arms may be selectively adjustable. For example, as shown in FIG. 5, there may be one or more stops or obstructions 30 that prevent the nozzle and/or control arms from moving past a selected threshold position. The obstructions 30 may be movable about the range of motion and/or releasably positionable in a plurality of different locations with respect to the control arms, nozzles, and or passenger assembly to allow (and restrict) a selected range of motion of the control arms or nozzles. Such limitations on the range of movement of the nozzles or control arms may be instituted to prevent an operator from flying backward, from rapidly descending, or rapidly ascending during operation and use of the passenger assembly.

Figure 6:
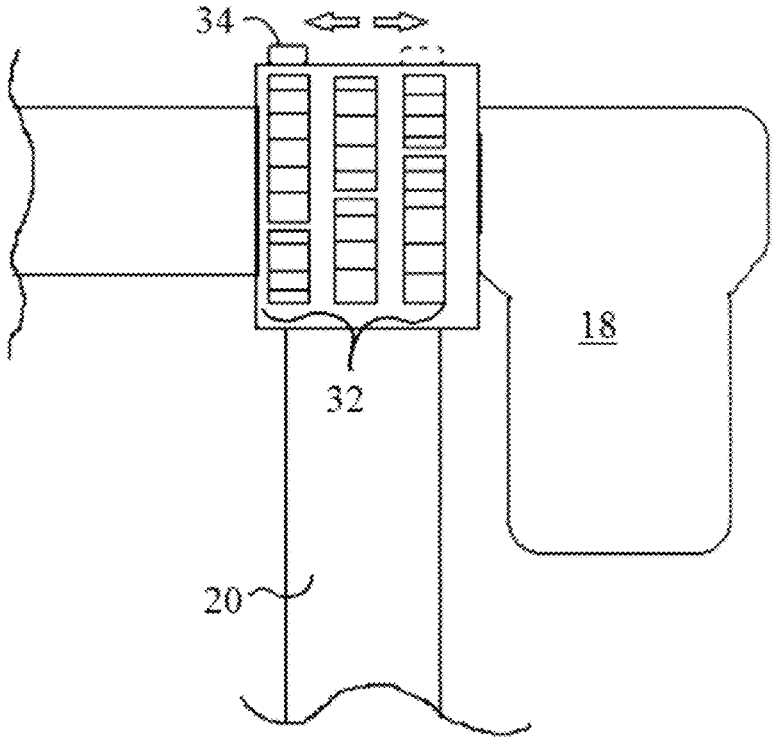
FIG. 6 is a front-view illustration of an example of a nozzle assembly constructed in accordance with the principles of the present disclosure.

The passenger assembly of the personal propulsion system may include one or more passenger or operator control elements or components that actuate or effect position and direction of the one or more nozzles, where a ratio of movement or the magnitude of the effect that the control element has on the nozzle is selectively adjustable. The selective adjustability allows an operator to modify the sensitivity of the passenger assembly control elements by selecting how the control element input affects the nozzle position. For example, as shown in FIG. 6, there may be one or more gears 32 coupled to the control arms, nozzles, and/or passenger assembly that affect the ratio between the movement of the control arm and the movement of the nozzle. The particular gearing may allow a range of configurations that are selectable through a selector switch 34 or the like that engages the control arms, nozzles, and/or passenger assembly to a particular gearing. For example, the gearing may provide one option of a direct 1:1 ratio of control arm movement to nozzle movement, may provide another option of a 3:1 ratio (e.g., the control input will have to be 3 times the magnitude of the 1:1 ratio to achieve the same nozzle movement), and other ratios as desired. The particular sensitivity of the control input elements may vary amongst individual operators and their applications. The gears or other adjustable control mechanism may be positioned about the nozzle(s) and/or other components of the passenger assembly so as not to interfere with one or more fluid flow paths delivering fluid to the nozzle(s). For example, the gears may be positioned in front of (i.e., anterior to) a flow path in fluid communication with the nozzle, and/or one or more portions of an exterior surface circumscribing the flow path may include one or more teeth or protrusions to engage the gears.

Figure 7:
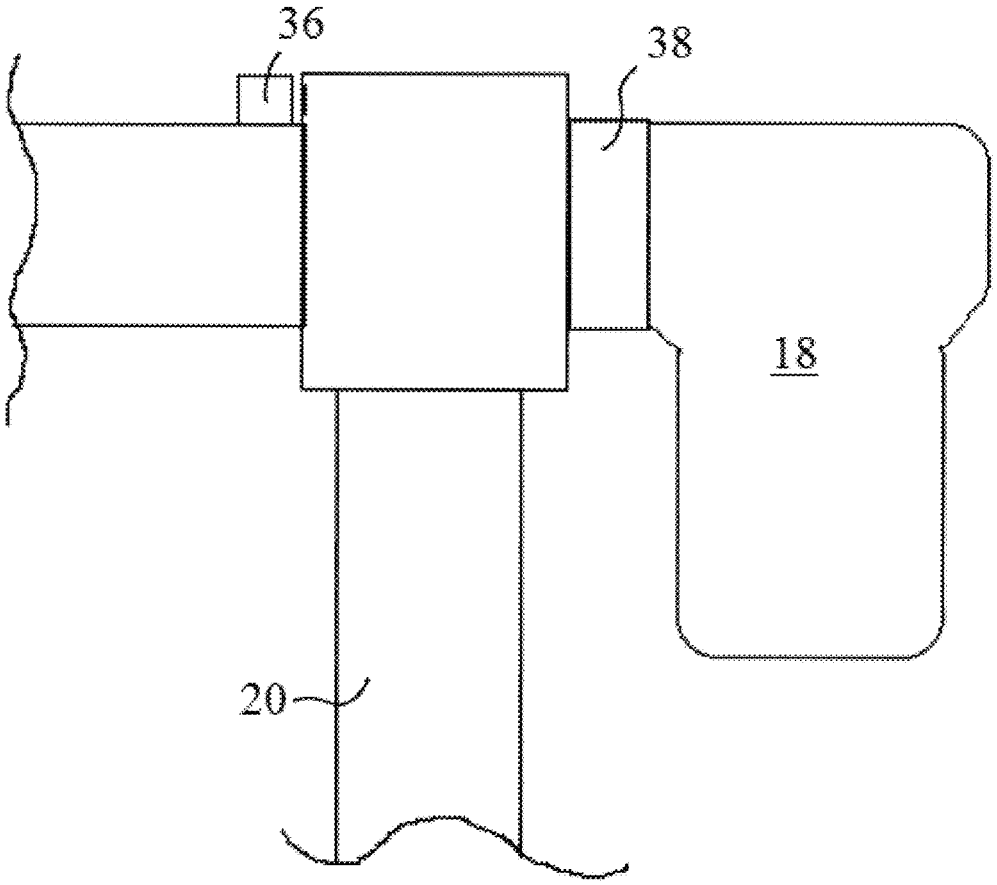
FIG. 7 is a front-view illustration of an example of a nozzle assembly constructed in accordance with the principles of the present disclosure.

Now referring to FIG. 7, alternatively and/or in addition to mechanically adjusting a ratio between control input and nozzle movement, such adjustable sensitivity may be achieved through the implementation of one or more sensors 36 that detect a position or movement of the control element. The detected position or movement of the control element may be communicated to a motor or other electro-mechanical apparatus that controls the movement of the nozzle to achieve a desired movement or rotational position of the nozzle. One or more processors and/or other hardware and software components may be implemented to allow an operator to select the desired sensitivity, with the sensor and motor communicating to effect the resulting desired nozzle position.

It will be appreciated by persons skilled in the art that the present invention is not limited to what has been particularly shown and described herein above. For example, though the illustrated example includes a device in a jetpack configuration, the features described herein are equally applicable to devices that provide propulsion about other regions of an operator's body, such as the feet or lower extremities (such as that shown in U.S. Pat. No. 8,336,805), as well as water-bicycle-type personal propulsion devices such as "the Jetovator" that utilize directional nozzles and passenger support assemblies.

It will be appreciated by persons skilled in the art that the present invention is not limited to what has been particularly shown and described herein above. In addition, unless mention was made above to the contrary, it should be noted that all of the accompanying drawings are not to scale. Of note, the system components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Moreover, while certain embodiments or figures described herein may illustrate features not expressly indicated on other figures or embodiments, it is understood that the features and components of the examples disclosed herein are not necessarily exclusive of each other and may be included in a variety of different combinations or configurations without departing from the scope and spirit of the invention. A variety of modifications and variations are possible in light of the above teachings without departing from the scope and spirit of the invention, which is limited only by the following claims.

What is claimed is:

1. A personal propulsion device adapted to achieve flight by discharging a fluid, comprising:

a passenger assembly adapted to support an individual person;

at least one fluid discharge nozzle coupled to the passenger assembly, wherein the nozzle is movable with respect to the passenger assembly to define a range of motion;

a passenger control element coupled to the nozzle; and one or more gears disposed between the control element and the nozzle, wherein the one or more gears are selectively engageable with at least one of the nozzle and control element, wherein the control element is operable to move the nozzle, and wherein an amount of movement that the nozzle travels in response to input from the control element is selectively adjustable.

2. The device of claim 1, wherein the one or more gears are selectively engageable to provide an adjustable movement ratio between the control element and the nozzle.

3. The device of claim 1, wherein the passenger assembly is configured to attach a person's torso.

4. The device of claim 1, further comprising a pressurized fluid source coupled to the passenger assembly, wherein the pressurized fluid source delivers pressurized fluid to the passenger assembly and does not achieve flight.

5. The device of claim 1, further comprising one or more obstructions coupled to the passenger assembly that are configured to restrict movement of at least one of the nozzle and the control element.

6. The device of claim 1, wherein the range of motion is selectively adjustable.

7. The device of claim 6, further comprising one or more obstructions movably coupled to the passenger assembly that are configured to restrict movement of at least one of the nozzle and the control element.

8. The device of claim 6, wherein the range of motion is selectively adjustable to substantially prevent a centerline axis of the nozzle from moving into a position between approximately 5° and approximately 45° frontward of a vertical centerline of the passenger assembly.

9. The device of claim 1, wherein the nozzle is biased towards at least one position in the range of motion.

10. The device of claim 9, further comprising at least one of a spring, magnet, elastic component, elastomeric component, and dampening component that at least in part biases the nozzle towards the at least one position.

11. The device of claim 10, wherein a force exerted by the at least one of a spring, magnet, elastic component, elastomeric component, and dampening component on the nozzle is selectively adjustable.

12. The device of claim 9, wherein a magnitude of the biasing of the nozzle is selectively adjustable.

13. A personal propulsion device adapted to achieve flight by discharging a fluid, comprising:

a passenger assembly adapted to support an individual person;

at least one fluid discharge nozzle coupled to the passenger assembly, wherein the nozzle is movable with respect to the passenger assembly to define a range of motion;

a passenger control element coupled to the nozzle, wherein the control element is operable to move the nozzle, and wherein an amount of movement that the nozzle travels in response to input from the control element is selectively adjustable;

a sensor operable to detect a movement of the control arm; and a motor coupled to the nozzle, wherein the motor is operable to move the nozzle based at least partially on a detected movement of the control arm.

14. The device of claim 13, further comprising a pressurized fluid source coupled to the passenger assembly, wherein the pressurized fluid source delivers pressurized fluid to the passenger assembly and does not achieve flight.

15. The device of claim 13, wherein the passenger assembly is configured to attach a person's torso.

16. A personal propulsion device adapted to achieve flight by discharging a fluid, comprising:

a passenger assembly adapted to support an individual person;

at least one fluid discharge nozzle coupled to the passenger assembly, wherein the nozzle is movable with respect to the passenger assembly to define a range of motion; and a passenger control element coupled to the nozzle, wherein the control element is operable to move the nozzle, and wherein an amount of movement that the nozzle travels in response to input from the control element is selectively adjustable, wherein the nozzle is biased towards at least one position in the range of motion, and wherein the at least one position is selectively adjustable to be any selected, discrete position in the range of motion.

17. The device of claim 16, further comprising at least one of a spring, magnet, elastic component, elastomeric component, and dampening component that at least in part biases the nozzle towards the at least one position.

18. The device of claim 17, wherein a force exerted by the at least one of a spring, magnet, elastic component, elastomeric component, and dampening component on the nozzle is selectively adjustable.

19. The device of claim 16, further comprising a pressurized fluid source coupled to the passenger assembly, wherein the pressurized fluid source delivers pressurized fluid to the passenger assembly and does not achieve flight.

20. The device of claim 16, wherein the passenger assembly is configured to attach a person's torso.

* * * * *